US011352994B1

(12) United States Patent
Uckermark et al.

(10) Patent No.: US 11,352,994 B1
(45) Date of Patent: Jun. 7, 2022

(54) FUEL PUMP AND COMBINATION OUTLET AND PRESSURE RELIEF VALVE THEREOF

(71) Applicant: DELPHI TECHNOLOGIES IP LIMITED, St. Michael (BB)

(72) Inventors: Chad E. Uckermark, Warwick, NY (US); Adam S. Johnson, Rochester, NY (US)

(73) Assignee: DELPHI TECHNOLOGIES IP LIMITED, St. Michael (BB)

( * ) Notice: Subject to any disclaimer, the term of this patent is extended or adjusted under 35 U.S.C. 154(b) by 0 days.

(21) Appl. No.: 17/146,580

(22) Filed: Jan. 12, 2021

(51) Int. Cl.
*F02M 59/36* (2006.01)
*F02M 59/46* (2006.01)
*F02M 63/00* (2006.01)

(52) U.S. Cl.
CPC ..... *F02M 59/366* (2013.01); *F02M 59/462* (2013.01); *F02M 63/005* (2013.01); *F02M 2200/09* (2013.01); *F02M 2200/50* (2013.01)

(58) Field of Classification Search
CPC ..... F02M 55/04; F02M 59/02; F02M 59/025; F02M 59/366; F02M 59/368; F02M 59/46; F02M 59/462; F02M 63/005; F02M 63/0054; F02M 63/0075; F02M 63/0077; F02M 2200/09; F02M 2200/50
See application file for complete search history.

(56) References Cited

U.S. PATENT DOCUMENTS 1,933,454 A 10/1933 Sidney
4,099,894 A 7/1978 Indra
4,577,606 A 3/1986 Bohringer et al.
4,834,134 A 5/1989 Asami et al.
4,926,902 A 5/1990 Nakamura et al.
5,839,414 A 11/1998 Klinger et al.
7,086,388 B2 8/2006 Roth et al.
7,267,108 B2 9/2007 Barylski et al.
8,132,558 B2 3/2012 Lucas et al.
9,181,944 B2 11/2015 Kuroyanagi et al.
9,409,652 B2 8/2016 Espinosa Sanchez
9,644,585 B2 5/2017 Lucas
9,683,559 B2 6/2017 Usui et al.
9,828,958 B2 11/2017 Saito
(Continued)

FOREIGN PATENT DOCUMENTS

DE 3149032 A1 * 6/1983 ..... F02M 59/462
DE 102013204563 A1 * 9/2014 ..... F02M 59/462
(Continued)

*Primary Examiner* — John M Zaleskas
(74) *Attorney, Agent, or Firm* — Joshua M. Haines

(57) ABSTRACT

An outlet and pressure relief valve assembly for a fuel pump includes a housing which extends along an axis from an inner end to an outer end. The housing has a bore which extends thereinto along the axis from the inner end. A valve seat is located within the bore and has an end wall which is transverse to the axis and also has a sidewall which is annular in shape and extends away from the end wall. An outlet flow passage extends through the end wall such that the outlet flow passage is centered about the axis. A pressure relief flow passage extends through the end wall such that the pressure relief flow passage is laterally spaced from the outlet flow passage. An outlet valve member is located within the valve seat sidewall and a pressure relief valve member is located between the valve seat and the inner end.

16 Claims, 7 Drawing Sheets

(56) References Cited

U.S. PATENT DOCUMENTS 9,989,050 B2 6/2018 Asayama et al.
10,030,650 B2 7/2018 Kuroyanagi et al.
10,907,600 B1 * 2/2021 Uckermark ..... F02M 63/005
2006/0231078 A1 * 10/2006 Barylski ..... F02M 37/0082 123/511
2011/0126804 A1 * 6/2011 Lucas ..... F02M 59/462 123/456
2012/0195780 A1 * 8/2012 Matsumoto ..... F02M 59/02 417/559
2012/0222759 A1 * 9/2012 Knis ..... F16K 1/443 137/512.2
2012/0227711 A1 * 9/2012 Saito ..... F02M 59/462 123/506
2012/0247591 A1 * 10/2012 Kuroyanagi ..... F02M 59/44 137/565.01
2012/0251366 A1 * 10/2012 Kuroyanagi ..... F04B 49/24 417/440
2013/0213504 A1 * 8/2013 Yabuuchi ..... F02M 63/0056 137/565.15
2014/0199192 A1 * 7/2014 Asayama ..... F04B 49/22 417/437
2014/0199194 A1 * 7/2014 Usui ..... F04B 11/0016 417/510
2014/0255219 A1 * 9/2014 Lucas ..... F04B 7/0076 417/282
2014/0305410 A1 10/2014 Lucas
2014/0314605 A1 10/2014 Koga et al.
2015/0078922 A1 3/2015 Oikawa et al.
2015/0152862 A1 * 6/2015 Matsumoto ..... F02M 37/06 417/559
2015/0203210 A1 7/2015 Espinosa Sanchez
2015/0361935 A1 * 12/2015 Nakaoka ..... F02M 59/464 417/437
2016/0010607 A1 1/2016 Lucas
2016/0025054 A1 * 1/2016 Kuroyanagi ..... F04B 53/109 417/440
2016/0115953 A1 * 4/2016 Kuroyanagi ..... F02M 59/025 417/559
2016/0258402 A1 9/2016 Abbas
2016/0348657 A1 * 12/2016 Matsumoto ..... F02M 59/102
2018/0045155 A1 * 2/2018 Saito ..... F02M 59/462
2018/0135580 A1 * 5/2018 Koga ..... F02M 69/54
2018/0163682 A1 * 6/2018 Koga ..... F02M 63/005
2018/0291855 A1 * 10/2018 Mikhaylov ..... F02M 63/0225
2018/0313314 A1 * 11/2018 Scheller ..... F16K 17/0406
2019/0085804 A1 * 3/2019 Han ..... F04B 53/101
2019/0085807 A1 * 3/2019 Han ..... F02M 63/005
2019/0170100 A1 * 6/2019 Koshimoto ..... F16K 24/02
2019/0211788 A1 * 7/2019 Kodama ..... F02M 59/366
2019/0219016 A1 7/2019 Zankl et al.
2020/0011279 A1 1/2020 Dauer et al.
2020/0088147 A1 3/2020 Koga et al.
2020/0102924 A1 * 4/2020 Perry ..... F16K 15/026
2020/0173391 A1 * 6/2020 Perry ..... F04B 49/225
2020/0263646 A1 * 8/2020 Perry ..... F02M 59/027
2020/0309076 A1 * 10/2020 Kazour ..... F02M 59/025

FOREIGN PATENT DOCUMENTS

DE 102013224816 A1 * 6/2015 ..... F02M 63/005
GB 2058948 A * 4/1981 ..... F02M 59/462
JP 02132847 U * 11/1990
JP 06058223 A * 3/1994 ..... F02M 59/462
JP 2013167259 A 8/2013
JP 2014136973 A * 7/2014 ..... F02M 59/462
JP 2014136973 A 7/2014
JP 2020118093 A * 8/2020 ..... F04B 1/0452
KR 20110051826 A * 5/2011 ..... F02M 59/462
WO WO-2014079625 A1 * 5/2014 ..... F04B 49/22

* cited by examiner

FUEL PUMP AND COMBINATION OUTLET AND PRESSURE RELIEF VALVE THEREOF

TECHNICAL FIELD OF INVENTION

The present disclosure relates to a fuel pump which supplies fuel to an internal combustion engine, more particularly to such a fuel pump which includes a pumping plunger which reciprocates in a pumping chamber, and even more particularly a combination outlet and pressure relief valve for such a fuel pump.

BACKGROUND OF INVENTION

Fuel systems in modern internal combustion engines fueled by gasoline, particularly for use in the automotive market, employ gasoline direct injection (GDi) where fuel injectors are provided which inject fuel directly into combustion chambers of the internal combustion engine. In such systems employing GDi, fuel from a fuel tank is supplied under relatively low pressure by a low-pressure fuel pump which is typically an electric fuel pump located within the fuel tank. The low-pressure fuel pump supplies the fuel to a high-pressure fuel pump which typically includes a pumping plunger which is reciprocated by a camshaft of the internal combustion engine. Reciprocation of the pumping plunger further pressurizes the fuel in a pumping chamber of the high-pressure fuel pump in order to be supplied to fuel injectors which inject the fuel directly into the combustion chambers of the internal combustion engine. An outlet valve is typically included in an outlet passage of the high-pressure fuel pump where the outlet valve prevents flow of fuel back into the pumping chamber during an intake stroke of the pumping plunger. Additionally, a pressure relief valve is known to be provided to allow fuel to flow back into the pumping chamber if the pressure downstream of the high-pressure fuel pump exceeds a predetermined level which may result in unsafe operating conditions. In some known arrangements, the outlet valve and pressure relief valve are packaged in a common assembly. However, in such known arrangements, flow paths for the fuel being discharged from the fuel pump may be tortuous and therefore reduce efficiency. Furthermore, it is common in such known arrangements to use planar surfaces to provide sealing for the outlet valve function, however, it is known that sealing using such a sealing arrangement may be susceptible to causing noise during operation at high opening and closing frequencies as will be experienced in high pressure fuel pumps. Also in such known arrangements, manufacturing may be complex which leads to added cost.

What is needed is a fuel pump and a combination outlet valve and pressure relief valve which minimize or eliminate one or more of the shortcomings as set forth above and provide an alternative for fuel systems.

SUMMARY OF THE INVENTION

Briefly described, the present disclosure provides a fuel pump which includes a fuel pump housing with a pumping chamber defined therein, the fuel pump housing having an outlet valve bore, the outlet valve bore extending along, and being centered about, an outlet valve bore axis; a pumping plunger which reciprocates within a plunger bore along a plunger bore axis such that an intake stroke of the pumping plunger increases volume of the pumping chamber and a compression stroke of the pumping plunger decreases volume of the pumping chamber; and an outlet and pressure relief valve assembly. The outlet and pressure relief valve assembly includes a valve housing which extends along the outlet valve bore axis from an inner end, which is proximal to the pumping chamber, to an outer end which is outside of the fuel pump housing, the valve housing having a valve housing bore which extends into the valve housing along the outlet valve bore axis from the inner end, the valve housing also having an outlet passage which is in fluid communication with the valve housing bore and extending to the outer end; a valve seat located within the valve housing bore, the valve seat having a valve seat end wall which is transverse to the outlet valve bore axis and also having a valve seat sidewall which is annular in shape and extends away from the valve seat end wall, wherein an outlet flow passage extends through the valve seat end wall such that the outlet flow passage is centered about the outlet valve bore axis and wherein a pressure relief flow passage extends through the valve seat end wall such that the pressure relief flow passage is laterally spaced from the outlet flow passage relative to the outlet valve bore axis; an outlet valve member which is located within the valve seat sidewall such that the outlet valve member is moveable between 1) a seated position which prevents flow through the valve housing in a first direction from the outer end to the inner end and 2) an unseated position which allows flow through the valve housing in a second direction from the inner end to the outer end; and a pressure relief valve member which is located between the valve seat and the inner end such that the pressure relief valve member is moveable between 1) a seated position which prevents flow through the valve housing in the second direction and 2) an unseated position which allows flow through the valve housing in the first direction.

The present disclosure also provides an outlet and pressure relief valve assembly for a fuel pump. The outlet and pressure relief valve assembly includes a valve housing which extends along an axis from an inner end to an outer end, the valve housing having a valve housing bore which extends into the valve housing along the axis from the inner end, the valve housing also having an outlet passage which is in fluid communication with the valve housing bore and extending to the outer end; a valve seat located within the valve housing bore, the valve seat having a valve seat end wall which is transverse to the axis and also having a valve seat sidewall which is annular in shape and extends away from the valve seat end wall, wherein an outlet flow passage extends through the valve seat end wall such that the outlet flow passage is centered about the axis and wherein a pressure relief flow passage extends through the valve seat end wall such that the pressure relief flow passage is laterally spaced from the outlet flow passage relative to the axis; an outlet valve member which is located within the valve seat sidewall such that the outlet valve member is moveable between 1) a seated position which prevents flow through the valve housing in a first direction from the outer end to the inner end and 2) an unseated position which allows flow through the valve housing in a second direction from the inner end to the outer end; and a pressure relief valve member which is located between the valve seat and the inner end such that the pressure relief valve member is moveable between 1) a seated position which prevents flow through the valve housing in the second direction and 2) an unseated position which allows flow through the valve housing in the first direction.

The fuel pump with outlet and pressure relief valve assembly as described herein allows for ease of manufacturing and low cost of manufacturing while providing efficient outlet flow and minimizing noise during operation.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This disclosure will be further described with reference to the accompanying drawings in which.

DETAILED DESCRIPTION OF INVENTION

Figure 1:
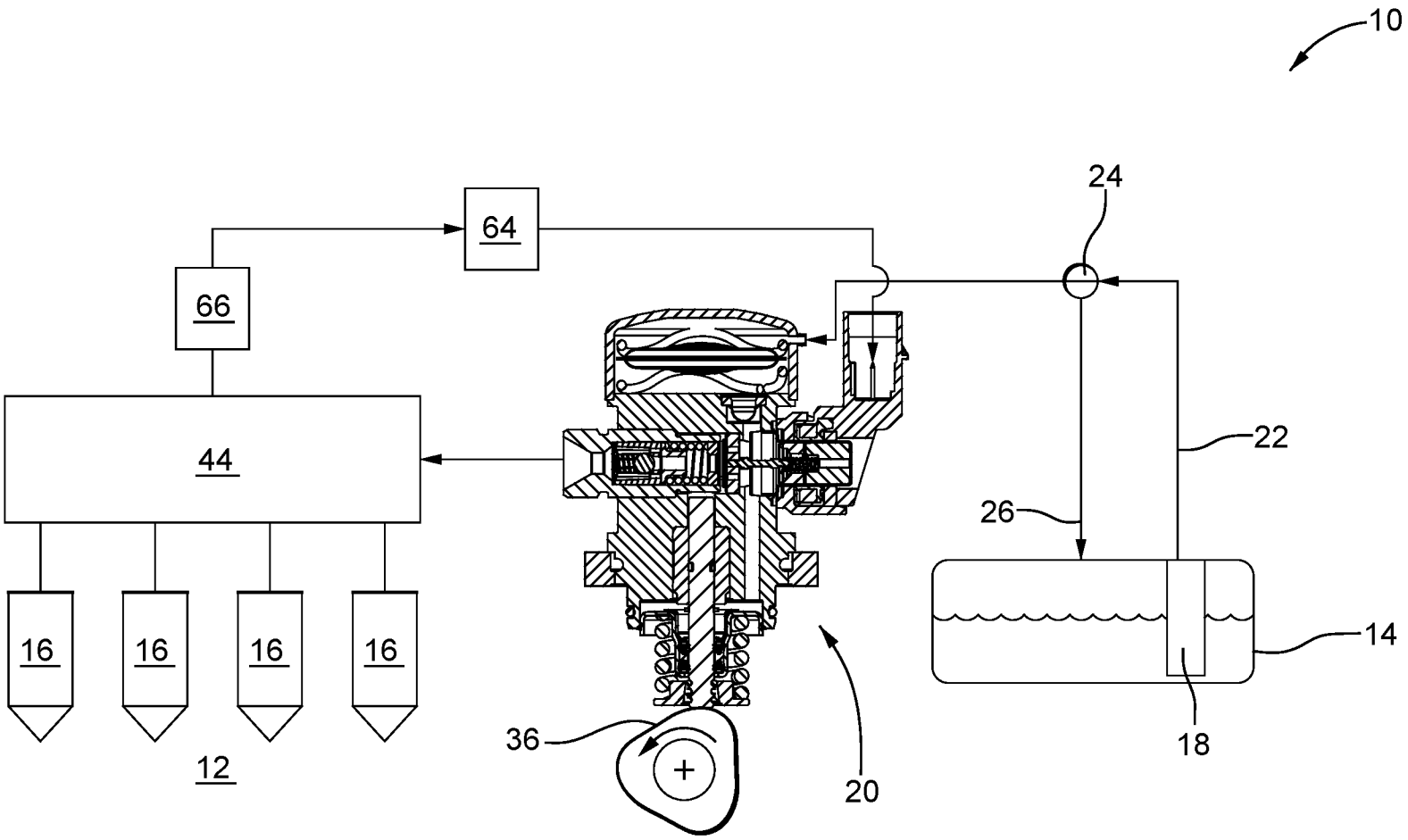
FIG. 1 is a schematic view of a fuel system including a fuel pump in accordance with the present disclosure.

In accordance with a preferred embodiment of this disclosure and referring initially to FIG. 1, a fuel system 10 for an internal combustion engine 12 is shown in schematic form. Fuel system 10 generally includes a fuel tank 14 which holds a volume of fuel to be supplied to internal combustion engine 12 for operation thereof; a plurality of fuel injectors 16 which inject fuel directly into respective combustion chambers (not shown) of internal combustion engine 12; a low-pressure fuel pump 18; and a high-pressure fuel pump 20 where the low-pressure fuel pump 18 draws fuel from fuel tank 14 and elevates the pressure of the fuel for delivery to high-pressure fuel pump 20 where the high-pressure fuel pump 20 further elevates the pressure of the fuel for delivery to fuel injectors 16. By way of non-limiting example only, low-pressure fuel pump 18 may elevate the pressure of the fuel to about 500 kPa or less and high-pressure fuel pump 20 may elevate the pressure of the fuel to above about 14 MPa and may be about 35 MPa depending on the operational needs of internal combustion engine 12. While four fuel injectors 16 have been illustrated, it should be understood that a lesser or greater number of fuel injectors 16 may be provided.

As shown, low-pressure fuel pump 18 may be provided within fuel tank 14, however low-pressure fuel pump 18 may alternatively be provided outside of fuel tank 14. Low-pressure fuel pump 18 may be an electric fuel pump as are well known to a practitioner of ordinary skill in the art. A low-pressure fuel supply passage 22 provides fluid communication from low-pressure fuel pump 18 to high-pressure fuel pump 20. A fuel pressure regulator 24 may be provided such that fuel pressure regulator 24 maintains a substantially uniform pressure within low-pressure fuel supply passage 22 by returning a portion of the fuel supplied by low-pressure fuel pump 18 to fuel tank 14 through a fuel return passage 26. While fuel pressure regulator 24 has been illustrated in low-pressure fuel supply passage 22 outside of fuel tank 14, it should be understood that fuel pressure regulator 24 may be located within fuel tank 14 and may be integrated with low-pressure fuel pump 18.

Figure 2:
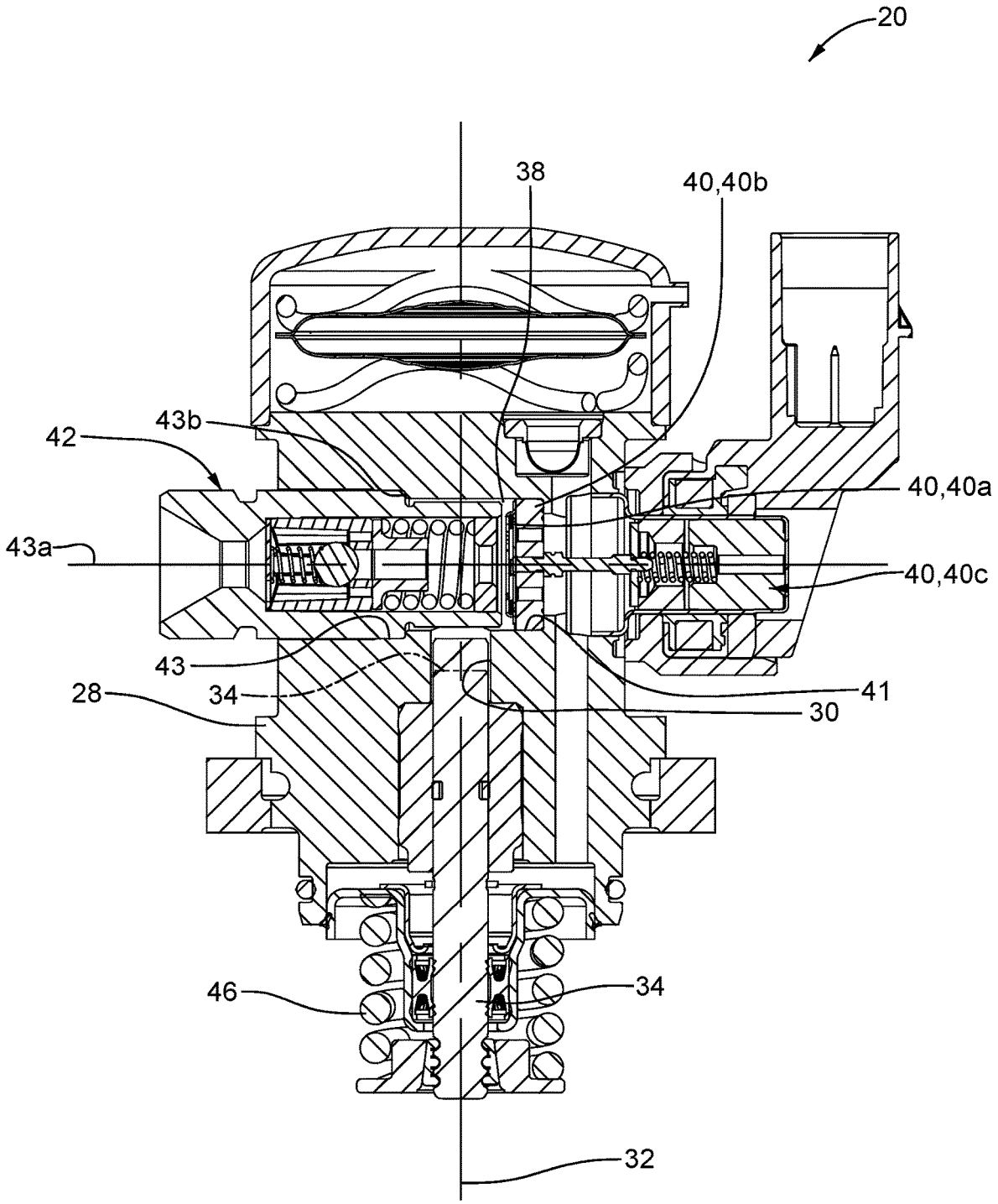
FIG. 2 is an enlarged cross-sectional view of the fuel pump of FIG. 1.

Now with additional reference to FIG. 2, high-pressure fuel pump 20 includes a fuel pump housing 28 which includes a plunger bore 30 which extends along, and is centered about, a plunger bore axis 32. As shown, plunger bore 30 may be defined by a combination of an insert and directly by fuel pump housing 28 but may alternatively be formed only, and directly by, fuel pump housing 28. High-pressure fuel pump 20 also includes a pumping plunger 34 which is located within plunger bore 30 and reciprocates within plunger bore 30 along plunger bore axis 32 based on input from a rotating camshaft 36 of internal combustion engine 12 (shown only in FIG. 1). A pumping chamber 38 is defined within fuel pump housing 28. An inlet valve assembly 40 of high-pressure fuel pump 20 is located within a pump housing inlet passage 41 of fuel pump housing 28 and selectively allows fuel from low-pressure fuel pump 18 to enter pumping chamber 38 while an outlet and pressure relief valve assembly 42 is located within an outlet valve bore 43 of fuel pump housing 28 and selectively allows fuel to be communicated from pumping chamber 38 to fuel injectors 16 via a fuel rail 44 to which each fuel injector 16 is in fluid communication. Outlet and pressure relief valve assembly 42 also provides a fluid path back to pumping chamber 38 if the pressure downstream of outlet and pressure relief valve assembly 42, i.e. between outlet and pressure relief valve assembly 42 and fuel injectors 16, reaches a predetermined limit which may pose an unsafe operating condition if left unmitigated. Outlet valve bore 43 is centered about, and extends along, an outlet valve bore axis 43*a*. In operation, reciprocation of pumping plunger 34 causes the volume of pumping chamber 38 to increase during an intake stroke of pumping plunger 34 (downward as oriented in FIG. 2) in which a plunger return spring 46 causes pumping plunger 34 to move downward, and conversely, the volume of pumping chamber 38 decreases during a compression stroke (upward as oriented in FIG. 2) in which camshaft 36 causes pumping plunger 34 to move upward against the force of plunger return spring 46. In this way, fuel is drawn into pumping chamber 38 during the intake stroke, and conversely, fuel is pressurized within pumping chamber 38 by pumping plunger 34 during the compression stroke, depending on the state of operation of inlet valve assembly 40 as will be described in greater detail later, and discharged through outlet and pressure relief valve assembly 42 under pressure to fuel rail 44 and fuel injectors 16. For clarity, a portion of pumping plunger 34 is shown in phantom lines in FIG. 2 to represent the intake stroke at a bottom dead center position (volume of pumping chamber 38 is maximized) and pumping plunger 34 is shown in solid lines in FIG. 2 to represent the compression stroke at a top dead center position (volume of pumping chamber 38 is minimized) such that pumping plunger 34 reciprocates between the bottom dead center position and the top dead center position.

Outlet and pressure relief valve assembly 42 will now be discussed with continued reference to FIGS. 1 and 2 and additionally with particular reference to FIGS. 3-7. Outlet and pressure relief valve assembly 42 generally includes a valve housing 48 which is tubular and extends along outlet valve bore axis 43*a* from an inner end 48*a*, which is proximal to pumping chamber 38, to an outer end 48*b*, which is distal from pumping chamber 38 and outside of fuel pump housing 28. A valve housing bore 48*c* extends into valve housing 48 from inner end 48*a* along outlet valve bore axis 43*a* such that valve housing bore 48*c* is centered about outlet valve bore axis 43*a*. Valve housing bore 48*c* extends from inner end 48*a* to a shoulder 48*d* which is transverse to outlet valve bore axis 43*a* and which faces toward inner end 48*a*. A valve housing outlet passage 48*e* extends from shoulder 48*d* to outer end 48*b* such that valve housing outlet passage 48*e* provides fluid communication from valve housing bore 48*c* to outer end 48*b*. The inner periphery of valve housing bore 48*c* and valve housing outlet passage 48*e* are each surfaces of revolution centered about outlet valve bore axis 43*a*. Similarly, the outer periphery of valve housing 48 is a surface of revolution centered about outlet valve bore axis 43*a*. Furthermore, the outer periphery of valve housing 48 includes an external shoulder 48*f* which is annular in shape and which is transverse to outlet valve bore axis 43*a* such that external shoulder 48*f* engages a complementary internal shoulder 43*b* of outlet valve bore 43, thereby providing a stop to establish a position of outlet and pressure relief valve assembly 42 within outlet valve bore 43.

Outlet and pressure relief valve assembly 42 also includes a valve seat 50 which is located within valve housing bore 48*c* and is positioned either directly or indirectly by shoulder 48*d*. As illustrated herein, shoulder 48*d* indirectly positions valve seat 50 because an intermediate element, which will be described later, is disposed between valve seat 50 and shoulder 48*d* such that the intermediate member acts as an extension of shoulder 48*d* to provide a positive stop for valve seat 50, however, it is anticipated that valve seat 50 could alternatively directly contact shoulder 48*d*. Valve seat 50 includes a valve seat end wall 50*a* which is transverse to outlet valve bore axis 43*a*. Valve seat 50 also includes a valve seat sidewall 50*b* which is annular in shape and which extends away from valve seat end wall 50*a* such that valve seat sidewall 50*b* spaces valve seat end wall 50*a* away from shoulder 48*d*. An outlet flow passage 50*c* extends through valve seat end wall 50*a* such that outlet flow passage 50*c* is centered about outlet valve bore axis 43*a* and such that outlet flow passage 50*c* provides a path for fuel through valve seat end wall 50*a* when fuel flows from inner end 48*a* to outer end 48*b* in order to communicate pressurized fuel from pumping chamber 38 to fuel injectors 16. Furthermore, one or more pressure relief flow passages 50*d* extend through valve seat end wall 50*a* such that each pressure relief flow passage 50*d* is laterally spaced from outlet flow passage 50*c* relative to outlet valve bore axis 43*a*. In this way, pressure relief flow passages 50*d* are arranged in a polar array which is centered about outlet valve bore axis 43*a*. Pressure relief flow passages 50*d* provide a path for fuel through valve seat end wall 50*a* when fuel flows from outer end 48*b* to inner end 48*a* during an over-pressure condition downstream of outlet and pressure relief valve assembly 42. While two pressure relief flow passages 50*d* have been illustrated in the figures, it should be understood that different quantities may be used. The inner periphery of valve seat sidewall 50*b* includes a plurality of circumferentially alternating flow channels 50*e* and valve guides 50*f* such that flow channels 50*e* provide a path for fuel to flow therethrough. Valve seat 50 is sealed to valve housing 48 such that flow is prevented radially between the outer periphery of valve seat 50 and the inner periphery of valve housing bore 48*c*. For example, the outer periphery of valve seat 50 may engage the inner periphery of valve housing bore 48*c* in an interference fit.

Figure 3:
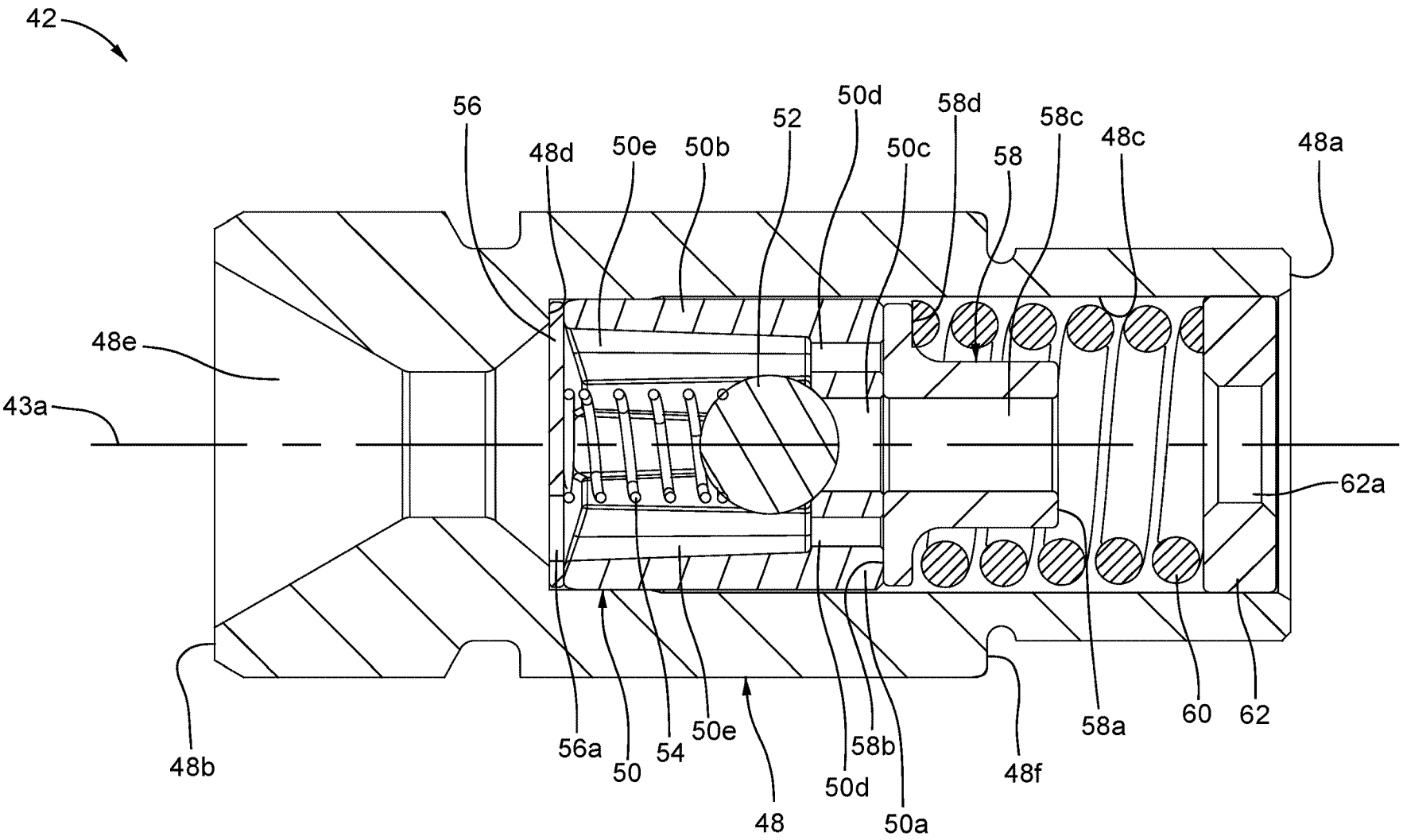
FIG. 3 is a cross-sectional view of an outlet and pressure relief valve assembly of the fuel pump of FIG. 1.
Figure 4:
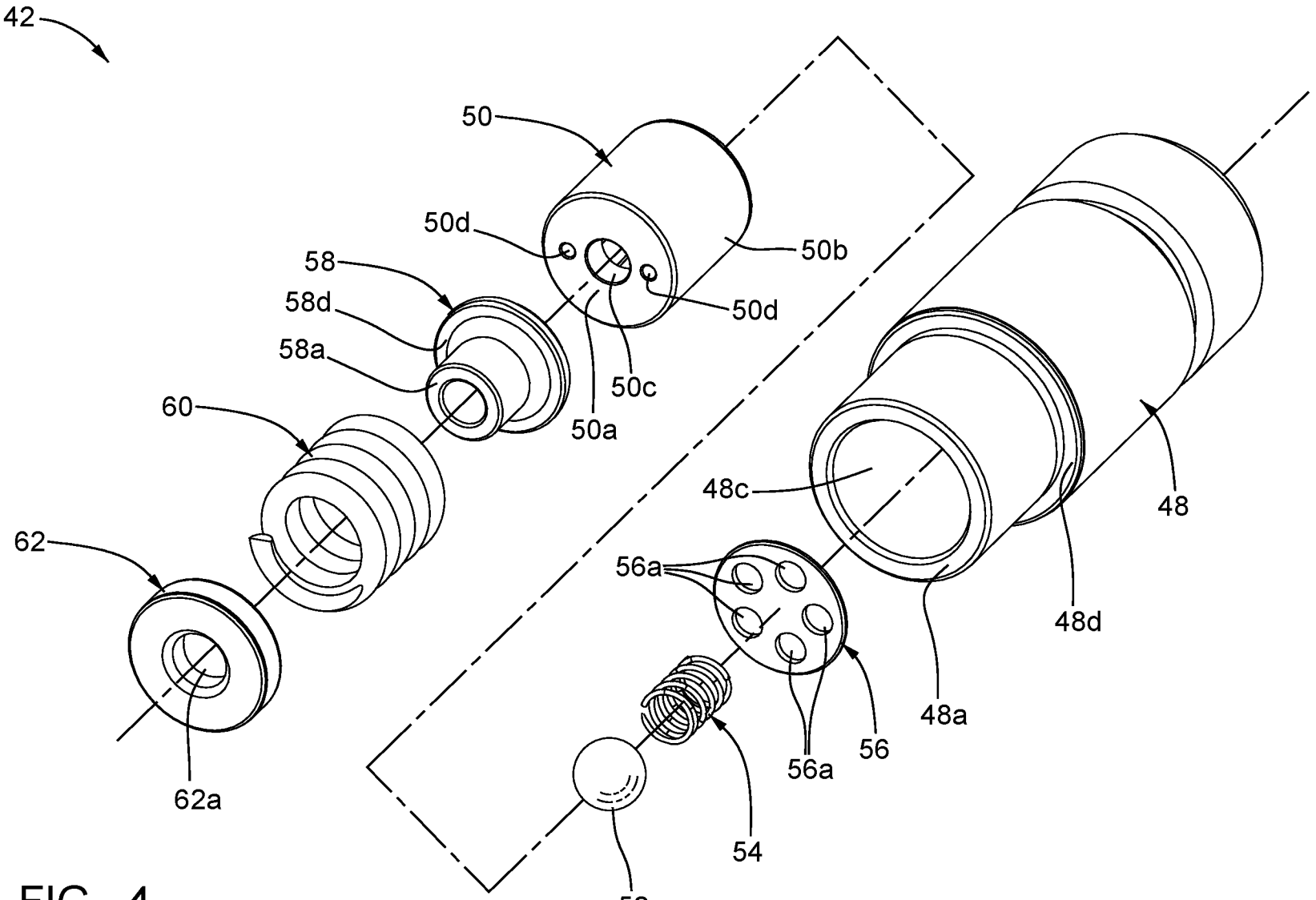
FIGS. 4 and 5 are exploded isometric views of the outlet and pressure relief valve assembly of FIG. 3 taken from different perspectives.
Figure 5:
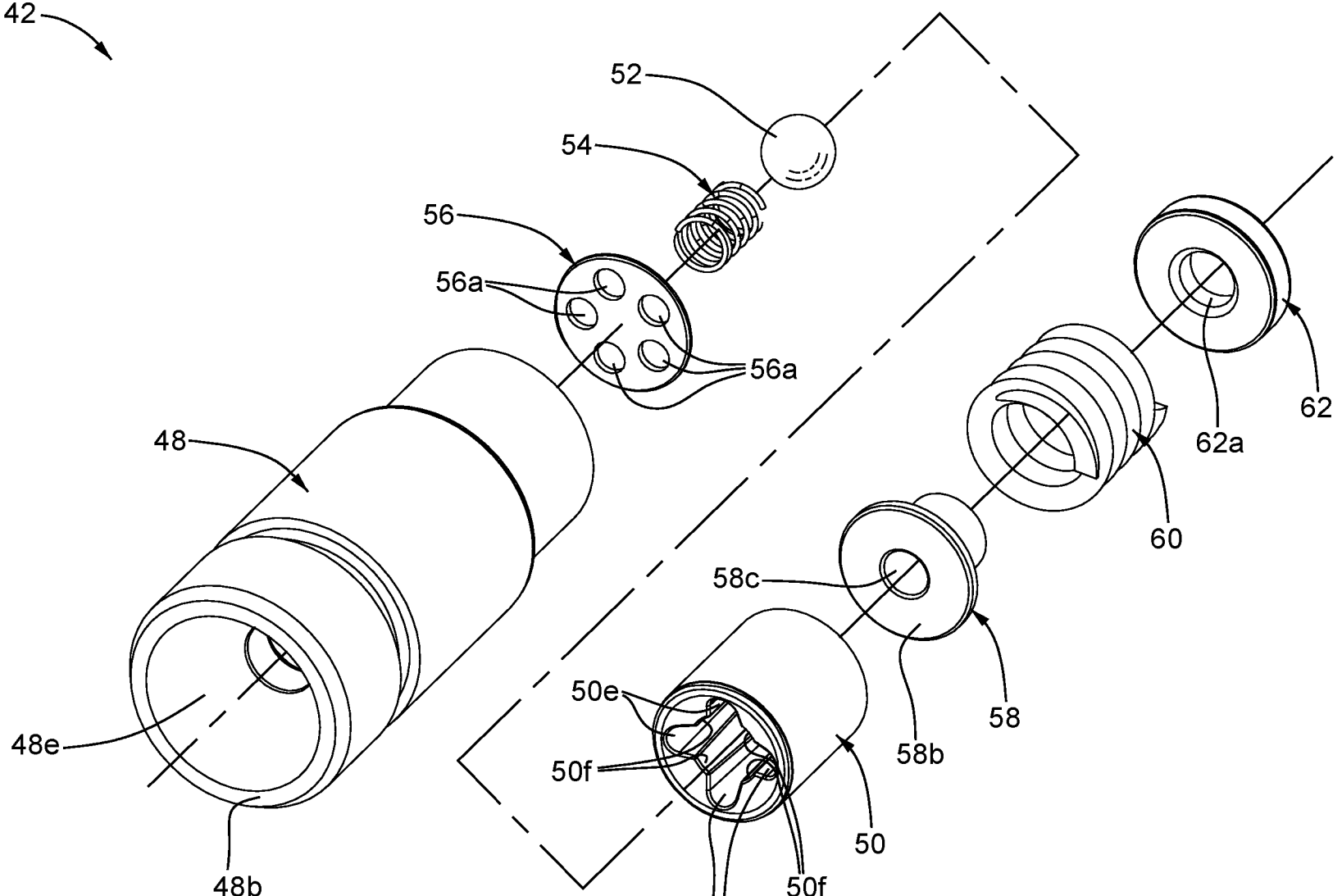
Figure 6:
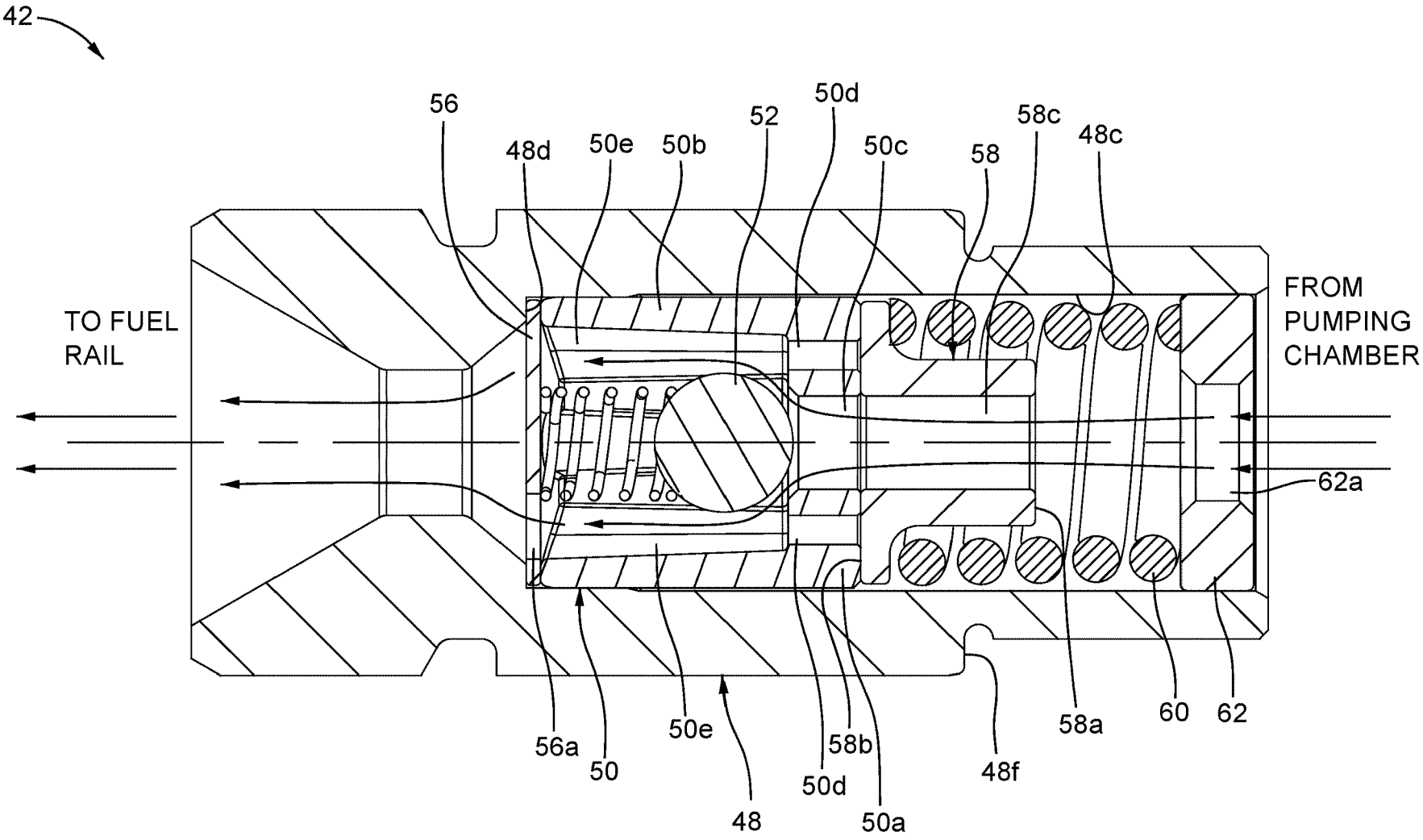
FIG. 6 is the cross-sectional view of FIG. 3 shown with an outlet valve member in an unseated position and arrows to show the path of fuel flow.
Figure 7:
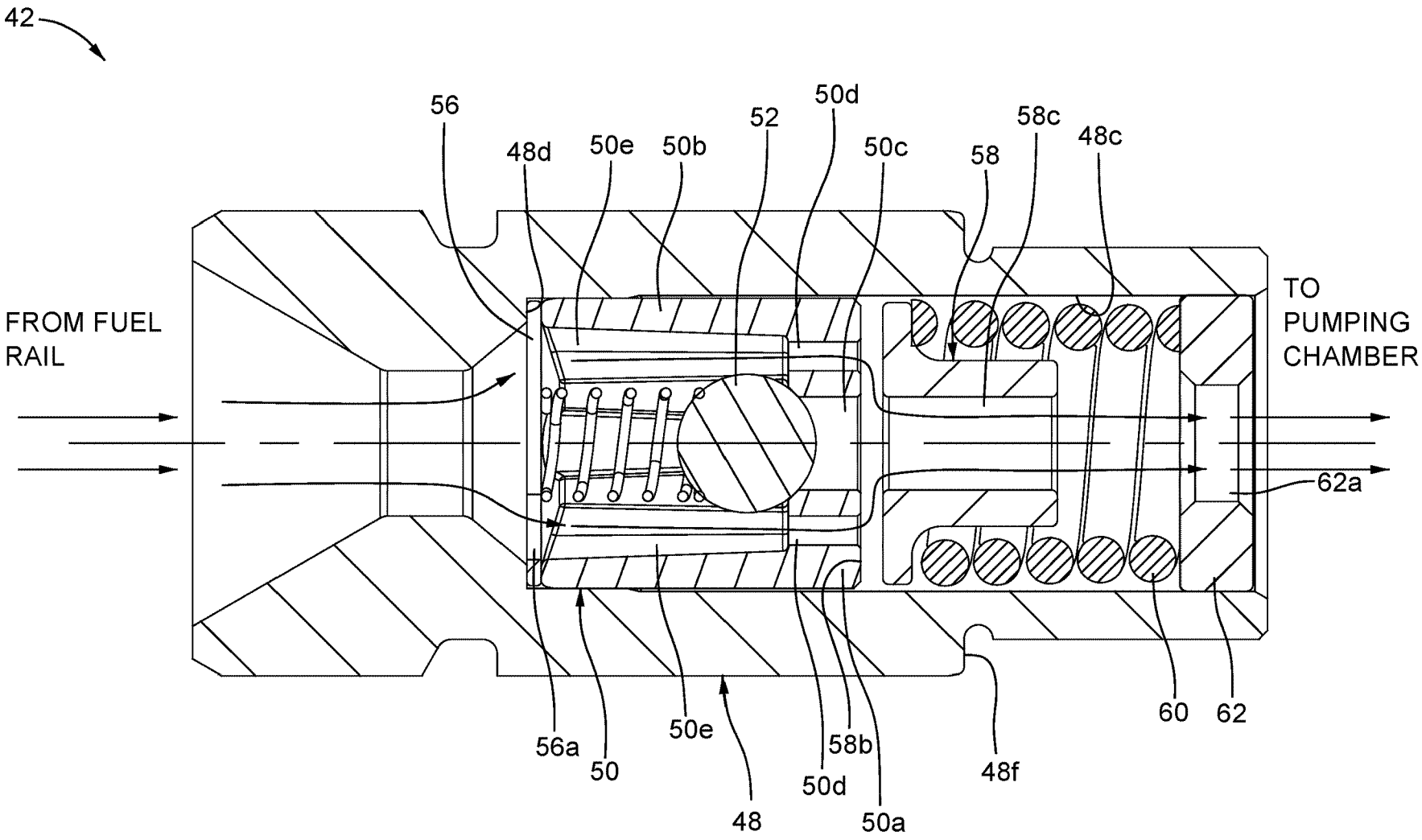
FIG. 7 is the cross-sectional view of FIG. 3 shown with a pressure relief valve member in an unseated position and arrows to show the path of fuel flow.

Outlet and pressure relief valve assembly 42 also includes an outlet valve member 52 which is located within valve seat sidewall 50*b* and which is moveable between 1) a seated position, shown in FIGS. 3 and 7, against said valve seat end wall 50*a* which prevents flow through valve housing 48 by way of outlet flow passage 50*c* in a first direction from outer end 48*b* to inner end 48*a* and 2) an unseated position, shown in FIG. 6, spaced apart from valve seat end wall 50*a* which allows flow through valve housing 48 by way of outlet flow passage 50*c* in a second direction from inner end 48*a* to outer end 48*b*. Movement of outlet valve member 52 in a direction laterally relative to outlet valve bore axis 43*a* is limited by valve guides 50*f* while flow channels 50*e* provide a path to flow around outlet valve member 52 when outlet valve member 52 is unseated. As illustrated herein, outlet valve member 52 is spherical. While outlet valve member 52 may be illustrated herein as a full sphere, spherical as used herein includes a portion of a sphere, such as a frustum of a sphere, a spherical cap, or a spherical segment. Alternatively, outlet valve member 52 may be conical or frustoconical. Outlet valve member 52 is biased toward valve seat end wall 50*a* by an outlet valve spring 54 which is grounded to valve housing 48 through an outlet valve spring seat 56 and which is located entirely within valve seat sidewall 50*b*. Outlet valve spring 54 is a coil compression spring and outlet valve spring seat 56 is a disk with one or more outlet valve spring seat apertures 56*a* extending therethrough to allow passage of fuel. Outlet valve spring seat apertures 56*a* are arranged in a polar array centered about outlet valve bore axis 43*a*, thereby allow the central portion of outlet valve spring seat 56 to remain solid to provide a surface for outlet valve spring 54 to engage. While five outlet valve spring seat apertures 56*a* have been illustrated in the figures, it should be understood that different quantities may be used. The outer edge of outlet valve spring seat 56 is captured axially between valve seat sidewall 50*b* and shoulder 48*d* such that outlet valve spring seat 56 engages both valve seat sidewall 50*b* and shoulder 48*d*. Since the outer edge of outlet valve spring seat 56 is captured axially between valve seat sidewall 50*b* and shoulder 48*d* such that outlet valve spring seat 56 engages both valve seat sidewall 50*b* and shoulder 48*d*, shoulder 48*d* indirectly positions valve seat 50 within valve housing bore 48*c*. In this way, valve seat 50 is pressed into place during assembly of outlet and pressure relief valve assembly 42 until it is stopped by shoulder 48*d* and outlet valve spring seat 56.

Outlet and pressure relief valve assembly 42 also includes a pressure relief valve member 58 located within valve housing bore 48*c* between valve seat 50 and inner end 48*a* such that pressure relief valve member 58 is moveable between 1) a seated position, shown in FIGS. 3 and 6, against valve seat end wall 50*a* which prevents flow through valve housing 48 in the second direction from inner end 48*a* to outer end 48*b* by way of pressure relief flow passages 50*d* and 2) an unseated position, shown in FIG. 7, spaced apart from valve seat end wall 50*a* which allows flow through valve housing 48 in the first direction from outer end 48*b* to inner end 48*a* by way of pressure relief flow passages 50*d*. Pressure relief valve member 58 is centered about outlet valve bore axis 43*a* such that pressure relief valve member 58 extends along outlet valve bore axis 43*a* from a pressure relief valve member inner end 58*a*, which is proximal to inner end 48*a*, to a pressure relief valve member outer end 58*b*, which is distal from inner end 48*a*. A pressure relief valve member outlet flow passage 58*c* extends axially through pressure relief valve member 58 from pressure relief valve member inner end 58*a* to pressure relief valve member outer end 58*b* such that pressure relief valve member outlet flow passage 58*c* provides a path for fuel to flow when outlet valve member 52 is unseated. Pressure relief valve member outlet flow passage 58*c* is centered about outlet valve bore axis 43*a*. The outer periphery of pressure relief valve member 58 is a surface of revolution about outlet valve bore axis 43*a* such that the outer periphery is stepped in diameter, thereby forming a pressure relief valve spring seat 58*d* which is annular in shape and which is transverse to outlet valve bore axis 43*a*, and is preferably perpendicular to outlet valve bore axis 43*a*. Pressure relief valve member outer end 58*b* is annular in shape, is planar, and projects over the entirety of pressure relief flow passages 50*d* such that pressure relief valve member 58 prevents fluid communication through pressure relief flow passages 50*d* when pressure relief valve member 58 is in the seated position.

Outlet and pressure relief valve assembly 42 also includes a pressure relief valve spring 60 which is located within valve housing bore 48*c*. It should be noted that pressure relief valve spring 60 is surrounded directly by valve seat sidewall 50*b*, i.e. there are no intermediate elements located radially between pressure relief valve spring 60 and valve seat sidewall 50*b*, thereby allowing any radial shift of pressure relief valve spring 60 to be controlled directly by valve housing 48. Pressure relief valve spring 60 is a coil compression spring which is held in pression by pressure relief valve spring seat 58*d* and a pressure relief valve spring retainer 62. Pressure relief valve spring retainer 62 is located within valve housing bore 48*c* and is annular in shape such that a pressure relief valve spring retainer outlet passage 62*a* extends axially, i.e. along outlet valve bore axis 43*a*, through pressure relief valve spring retainer 62, thereby providing a path for fuel to flow when outlet valve member 52 is unseated. Pressure relief valve spring retainer outlet passage 62*a* is centered about outlet valve bore axis 43*a*. The outer periphery of pressure relief valve spring retainer 62 is engaged with the inner periphery of valve housing bore 48*c* and during assembly of outlet and pressure relief valve assembly 42, pressure relief valve spring retainer 62 is pressed into valve housing bore 48*c* until a predetermined compression force, within an acceptable tolerance range, of pressure relief valve spring 60 is achieved. In this way, pressure relief valve member 58 is unseated from valve seat 50 when a predetermined pressure downstream of outlet and pressure relief valve assembly 42 occurs.

Inlet valve assembly 40 will now be described with particular reference to FIG. 2. Inlet valve assembly 40 generally includes an inlet valve member 40*a*, an inlet valve seat 40*b*, and a solenoid assembly 40*c*. Inlet valve member 40*a* and inlet valve seat 40*b* act together as a check valve which normally allows fuel to flow into pumping chamber 38 from pump housing inlet passage 41 when pumping plunger 34 is moving to expand the volume of pumping chamber 38, i.e. moving downward as oriented in the figures during the intake stroke, but prevents fuel from flowing from pumping chamber 38 to pump housing inlet passage 41 when pumping plunger 34 is moving to decrease the volume of pumping chamber 38, i.e. upward as oriented during the compression stroke. However, an electronic control unit 64 may be used to time the supply of an electric current to solenoid assembly 40*c* during the compression stroke, thereby varying the proportion of fuel from the compression stroke that is supplied to fuel injectors 16 and the proportion of fuel from the compression stroke that is spilled back to pump housing inlet passage 41. When an electric current is supplied to solenoid assembly 40*c*, inlet valve member 40*a* and inlet valve seat 40*b* act together as a check valve, i.e. fuel can flow into pumping chamber 38 through inlet valve assembly 40 but fuel cannot flow out of pumping chamber 38 through inlet valve assembly 40. Conversely, when no electric current is supplied to solenoid assembly 40*c*, inlet valve member 40*a* is held open, thereby allowing fuel to flow back to pump housing inlet passage 41 during a portion of the compression stroke, thereby allowing for the appropriate pressure and volume of fuel to be provided to fuel injectors 16. Inlet valve assembly 40 will not be describe further herein, however, further details may be found in United States Patent Application Publication No. US 2020/0011279 A1 to Dauer et al., the disclosure of which is hereby incorporated by reference in its entirety.

In operation, and with particular reference to FIGS. 2 and 6, when inlet valve assembly 40 is closed and pumping plunger 34 is in the compression stroke, pressure within pumping chamber 38 is elevated, thereby resulting in a force sufficient to cause outlet valve member 52 to unseat from valve seat end wall 50*a*. Consequently, outlet flow passage 50*c* is opened, thereby allowing fuel to flow from pumping chamber 38 to fuel injectors 16. It should be noted that the coaxial nature of pressure relief valve spring retainer outlet passage 62*a*, pressure relief valve member outlet flow passage 58*c*, and outlet flow passage 50*c* provides an unobstructed passage, in a direction parallel to outlet valve bore axis 43*a*, from inner end 48*a* to outlet valve member 52. As a result, the fuel passing through pressure relief valve assembly 42 from pumping chamber 38 to fuel injectors 16 departs from linear flow to flow around outlet valve member 52, however, the spherical nature of outlet valve member 52 provides for a smooth transition, thereby minimizing restriction to the outlet flow of fuel. It should also be noted that outlet valve member 52 is located entirely within fuel pump housing 28 which minimizes transmission of audible noise which may otherwise be transmitted to an operator of a motor vehicle containing internal combustion engine 12. Furthermore, valve housing 48 extends into pumping chamber 38 such that a portion of valve housing 48 is aligned with pumping plunger 34 in a direction parallel to plunger bore axis 32. This relationship minimizes the volume of pumping chamber 38 which is formed larger than necessary in order to accommodate installation of inlet valve seat 40*b*. If pumping chamber 38 is too large in volume, pumping efficiency can be reduced.

In operation, and with particular reference to FIGS. 2 and 7, if the pressure downstream of pressure relief valve assembly 42 exceeds a predetermined threshold, the force of pressure relief valve spring 60 is overcome, thereby allowing pressure relief valve member 58 to unseat from valve seat end wall 50*a*. Consequently, pressure relief flow passages 50*d* are opened, thereby allowing fuel pressure to be relieved back to pumping chamber 38, thereby mitigating the over-pressure condition downstream of pressure relief valve assembly 42. While pressure relief valve member 58 should rarely, if ever, open during the life of high-pressure fuel pump 20, it should be noted that pressure relief valve member 58 is located entirely within fuel pump housing 28 which minimizes transmission of audible noise which may otherwise be transmitted to an operator of a motor vehicle containing internal combustion engine 12. It should also be noted that the planar mating nature of pressure relief valve assembly 42 and valve seat end wall 50*a*, which may be more likely to produce noise, is more easily tolerated applied to the pressure relief function because of its low use over its lifetime.

High-pressure fuel pump 20 and outlet and pressure relief valve assembly 42 as described herein provides for ease of manufacturing and low cost of manufacturing. For example, only pressure relief valve spring retainer 62 needs to be set specific to each assembly and all other components are assembled to a hard stop. As another example, all passages, i.e. outlet flow passage 50*c*, pressure relief flow passages 50*d*, pressure relief valve member outlet flow passage 58*c*, and pressure relief valve spring retainer outlet passage 62*a* are formed parallel to outlet valve bore axis 43*a*, thereby eliminated the need for forming angled passages which can increase manufacturing complexity. Furthermore, outlet fuel flow is optimized due to only needing to flow around outlet valve member 52. Even furthermore, noise during operation is minimized since outlet valve member 52, which cycles rapidly, does not mate with valve seat 50 in a planar interface.

While this invention has been described in terms of preferred embodiments thereof, it is not intended to be so limited, but rather only to the extent set forth in the claims that follow.

We claim:

1. A fuel pump comprising:

a fuel pump housing with a pumping chamber defined therein, said fuel pump housing having an outlet valve bore, said outlet valve bore extending along, and being centered about, an outlet valve bore axis;

a pumping plunger which reciprocates within a plunger bore along a plunger bore axis such that an intake stroke of said pumping plunger increases volume of said pumping chamber and a compression stroke of said pumping plunger decreases volume of said pumping chamber; and an outlet and pressure relief valve assembly comprising:

a valve housing which extends along said outlet valve bore axis from an inner end, which is proximal to said pumping chamber, to an outer end which is outside of said fuel pump housing, said valve housing having a valve housing bore which extends into said valve housing along said outlet valve bore axis from said inner end, said valve housing also having an outlet passage which is in fluid communication with said valve housing bore and extending to said outer end;

a valve seat located within said valve housing bore, said valve seat having a valve seat end wall which is transverse to said outlet valve bore axis and also having a valve seat sidewall which is annular in shape and extends away from said valve seat end wall, wherein an outlet flow passage extends through said valve seat end wall such that said outlet flow passage is centered about said outlet valve bore axis and wherein a pressure relief flow passage extends through said valve seat end wall such that said pressure relief flow passage is laterally spaced from said outlet flow passage relative to said outlet valve bore axis;

an outlet valve member which is located within said valve seat sidewall such that said outlet valve member is moveable between 1) a seated position which prevents flow through said valve housing in a first direction from said outer end to said inner end and 2) an unseated position which allows flow through said valve housing in a second direction from said inner end to said outer end; and a pressure relief valve member which is located between said valve seat and said inner end such that said pressure relief valve member is moveable between 1) a seated position which prevents flow through said valve housing in said second direction and 2) an unseated position which allows flow through said valve housing in said first direction;

wherein said outlet valve member and said pressure relief valve member are both located entirely within said fuel pump housing; and wherein said plunger bore axis is transverse to said outlet valve bore axis and said valve housing is aligned with said pumping plunger in a direction parallel to said plunger bore axis.

2. The fuel pump as in claim 1, wherein:

said valve housing bore extends into said valve housing along said outlet valve bore axis from said inner end to a shoulder which is transverse to said outlet valve bore axis and which faces toward said inner end; and said valve seat is positioned within said valve housing bore either directly or indirectly by said shoulder.

3. The fuel pump as in claim 2, wherein said valve seat sidewall spaces said valve seat end wall away from said shoulder.

4. The fuel pump as in claim 1, wherein said outlet and pressure relief valve assembly further comprises an outlet valve spring which biases said outlet valve member toward said seated position, said outlet valve spring being located within said valve seat sidewall.

5. The fuel pump as in claim 4, wherein:

said valve housing bore extends into said valve housing along said outlet valve bore axis from said inner end to a shoulder which is transverse to said outlet valve bore axis and which faces toward said inner end;

said outlet valve assembly further comprises an outlet valve spring seat which is captured axially between said valve seat and said shoulder such that said outlet valve spring seat engages both said valve seat and said shoulder; and said outlet valve spring is grounded to said valve housing through said outlet valve spring seat.

6. The fuel pump as in claim 5, wherein said outlet valve spring is located entirely within said valve seat sidewall.

7. The fuel pump as in claim 1, wherein said outlet and pressure relief valve assembly further comprises a pressure relief valve spring which biases said pressure relief valve member toward said seated position, said pressure relief valve spring being surrounded directly by said valve housing.

8. The fuel pump as in claim 1, wherein an unobstructed passage is provided, in a direction parallel to said outlet valve bore axis, from said inner end to said outlet valve member.

9. An outlet and pressure relief valve assembly for a fuel pump, said outlet and pressure relief valve assembly comprising:

a valve housing which extends along an axis from an inner end to an outer end, said valve housing having a valve housing bore which extends into said valve housing along said axis from said inner end, said valve housing also having an outlet passage which is in fluid communication with said valve housing bore and extending to said outer end;

a valve seat located within said valve housing bore, said valve seat having a valve seat end wall which is transverse to said axis and also having a valve seat sidewall which is annular in shape and extends away from said valve seat end wall such that a volume is formed radially inward from said valve seat sidewall, wherein an outlet flow passage extends through said valve seat end wall such that said outlet flow passage is centered about said axis and wherein a pressure relief flow passage extends through said valve seat end wall such that said pressure relief flow passage is laterally spaced from said outlet flow passage relative to said axis and such that said pressure relief flow passage opens into said volume;

an outlet valve member which is located within said valve seat sidewall and within said volume such that said outlet valve member is moveable between 1) a seated position which prevents flow through said valve housing in a first direction from said outer end to said inner end and 2) an unseated position which allows flow through said valve housing via said volume in a second direction from said inner end to said outer end; and a pressure relief valve member which is located between said valve seat and said inner end such that said pressure relief valve member is moveable between 1) a seated position which prevents flow through said valve housing in said second direction and 2) an unseated position which allows flow through said valve housing via said volume in said first direction.

10. The outlet and pressure relief valve assembly as in claim 9, wherein:

said valve housing bore extends into said valve housing along said axis from said inner end to a shoulder which is transverse to said axis and which faces toward said inner end; and said valve seat is positioned within said valve housing bore either directly or indirectly by said shoulder.

11. The outlet and pressure relief valve assembly as in claim 10, wherein said valve seat sidewall spaces said valve seat end wall away from said shoulder.

12. The outlet and pressure relief valve assembly as in claim 9, wherein said outlet and pressure relief valve assembly further comprises an outlet valve spring which biases said outlet valve member toward said seated position, said outlet valve spring being located within said valve seat sidewall.

13. The outlet and pressure relief valve assembly as in claim 12, wherein:

said valve housing bore extends into said valve housing along said axis from said inner end to a shoulder which is transverse to said axis and which faces toward said inner end;

said outlet valve assembly further comprises an outlet valve spring seat which is captured axially between said valve seat and said shoulder such that said outlet valve spring seat engages both said valve seat and said shoulder; and said outlet valve spring is grounded to said valve housing through said outlet valve spring seat.

14. The outlet and pressure relief valve assembly as in claim 13, wherein said outlet valve spring is located entirely within said valve seat sidewall.

15. The outlet and pressure relief valve assembly as in claim 9, wherein said outlet and pressure relief valve assembly further comprises a pressure relief valve spring which biases said pressure relief valve member toward said seated position, said pressure relief valve spring being surrounded directly by said valve housing.

16. The outlet and pressure relief valve assembly as in claim 9, wherein an unobstructed passage is provided, in a direction parallel to said axis, from said inner end to said outlet valve member.

* * * * *